United States Patent [19]

Paik et al.

[11] Patent Number: 4,888,592

[45] Date of Patent: Dec. 19, 1989

[54] SATELLITE ANTENNA ALIGNMENT SYSTEM

[75] Inventors: Woo H. Paik; William Fong; Ashok K. Goerge, all of San Diego; John E. McCormick, El Cajon, all of Calif.

[73] Assignee: General Instrument Corporation, New York, N.Y.

[21] Appl. No.: 251,182

[22] Filed: Sep. 28, 1988

[51] Int. Cl.[4] ..... H01Q 3/00

[52] U.S. Cl. ..... 342/359; 342/356

[58] Field of Search ..... 342/359, 356, 352

[56] References Cited

U.S. PATENT DOCUMENTS 4,675,680 6/1987 Mori ..... 342/352

4,796,032 1/1989 Sakurai et al. ..... 342/359

OTHER PUBLICATIONS

Baylin and Gale, "Ku-Band Satellite TV Theory, Installation and Repair", 1986, p. 2020214.

*Primary Examiner*—Theodore M. Blum

*Attorney, Agent, or Firm*—Edward W. Callan

[57] ABSTRACT

A system for causing an antenna controller for a satellite antenna to determine the alignment position of the antenna for a given satellite, whereby antenna installation time may be substantially reduced when the alignment position of the antenna for a large number of satellites must be determined. The system includes means for measuring the alignment position of the antenna for at least two reference satellites; and means for processing said measurements with stored data indicating the relative positions of the reference satellites and other satellites in accordance with an algorithm to determine the alignment positions of the antenna for the other satellites. The system also includes means for causing an antenna controller for a satellite antenna to determine the skews of the linear polarization axis of the antenna for respectively matching the linear polarization axis of odd-numbered and even-numbered channels received from a satellite. One embodiment of the system also includes a portable device into which data indicating the relative positions of the reference satellites and the other satellites and/or data indicating relative skews for matching the linear polarization axis of odd-numbered and even-numbered channels received by a reference antenna from the satellites may be downloaded from the antenna controller for the reference antenna, and from which the downloaded data may be uploaded into the first said antenna controller for said storage therein.

14 Claims, 1 Drawing Sheet

SATELLITE ANTENNA ALIGNMENT SYSTEM

BACKGROUND OF THE INVENTION

The present invention generally pertains to alignment of satellite antennas and is particularly directed to a system for causing an antenna controller for a satellite antenna to determine the alignment position of the antenna for a given satellite.

The alignment position of a satellite antenna is controlled by an antenna controller, and must be determined for each of a plurality of satellites stationed in geosynchronous orbit above the Earth's equator in sight of the antenna. Typically, the antenna is attached to an antenna mount by an actuator and is rotated about a polar axis on the antenna mount moving the actuator in order to achieve alignment with a given satellite. Alignment data is displayed by a television monitor that is coupled to the antenna by a satellite receiver. The controller is operated to move the actuator to rotate the antenna into alignment with a given satellite. Alignment is determined by observing the quality of the television signal being received from the satellite and displayed by the monitor. The alignment position is indicated by a position count that is displayed by the monitor. Upon determining that the antenna is aligned with the given satellite, the alignment position count is stored in a memory location within the controller that is associated with the given satellite so that the antenna can be rotated to a position in alignment with the given satellite simply by accessing the stored alignment position count associated with the given satellite and causing the controller to move the actuator to rotate the antenna until the antenna position corresponds to the accessed count.

Once the antenna is aligned with a given satellite, the respective skews of the linear polarization axis of the antenna for matching the linear polarization axis of odd-numbered and even-numbered channels received from the given satellite must be determined. The odd-numbered and even-numbered channels received from any given satellite are skewed ninety degrees with respect to each other in order to reduce interference between adjacent channels.

For a given channel (which may be either odd-numbered or even-numbered), the skew of the antenna for matching the linear polarization axis of such channel as received from the given satellite is determined by causing the controller to rotate a probe within a mechanical polarizer of the antenna and observing the quality of the television signal being received from the given satellite and displayed by the monitor. Upon determining the skew at which the linear polarization axis of the antenna is matched with the linear polarization axis of the received channel, the skew data for such channel is stored in a memory location within the controller that is associated with such channel for the given satellite so that the antenna can be skewed to match the linear polarization axis for such channel of the given satellite whenever the antenna is rotated to a position in alignment with the given satellite simply by accessing the stored skew data associated with such channel of the given satellite and causing the controller to rotate the probe until the probe position corresponds to the accessed skew data. Since the angular relationship between the odd and even numbered channels for the given satellite is known, the installer uses the measured skew data that has been determined for one channel to calculate the skew data for the other channels, and the calculated skew data is stored for each of the channels of the given satellite.

Once the alignment position and the respective skews are determined for a given satellite, data indicating the determined alignment position and the respective determined skews for the given satellite are stored in the antenna controller.

Presently, there are over thirty satellites within sight of North America. Consequently, a substantial portion of the time spent in installing each new satellite antenna is spent in separately determining and storing the alignment position and skew data for each of these many satellites.

SUMMARY OF THE INVENTION

The present invention is an improved system for causing an antenna controller for a satellite antenna to determine the alignment position of the antenna for a given satellite, whereby antenna installation time may be substantially reduced when the alignment position of the antenna for a large number of satellites must be determined.

The system of the present invention includes means for measuring the alignment position of the antenna for at least two reference satellites; and means for processing said measurements with stored data indicating the relative positions of the reference satellites and other satellites in accordance with an algorithm to determine the alignment positions of the antenna for the other satellites.

The system of the present invention may further include means for causing an antenna controller for a satellite antenna to determine the skews of the linear polarization axis of the antenna for respectively matching the linear polarization axis of odd-numbered and even-numbered channels received from the other satellites. with such means including means for measuring the relative skews of the linear polarization axis of the antenna for matching the linear polarization axis of odd-numbered and even-numbered channels received by the given antenna from the other satellite; and means for processing said measurements with stored data indicating relative skews for matching the linear polarization axis of odd-numbered even-numbered and channels received by a reference antenna from the other satellites in accordance with an algorithm to determine the skew of the linear polarization axis of the antenna for respectively matching the linear polarization axis of odd and even-numbered channels received from the other satellites.

The system of the present invention may still further include a portable device into which data indicating the relative positions of and the reference satellites and the other satellites and/or data indicating relative skews for matching the linear polarization axis of odd-numbered and even-numbered channels received by a reference antenna from the other satelites may be downloaded from the antenna controller for the reference antenna, and from which the downloaded data may be uploaded into the the memory of the system for said storage therein.

Additional features of the present invention are described in relation to the description of the preferred embodiments.

DESCRIPTION OF THE PREFERRED EMBODIMENT

Figure 1:
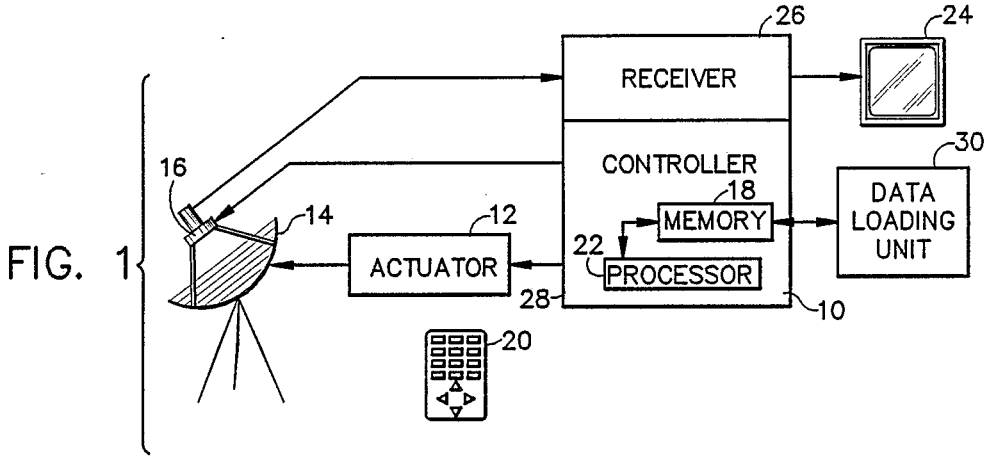
FIG. 1 is a block diagram of a preferred embodiment of the system of the present invention in combination with an antenna alignment system.

Referring to FIG. 1, in one preferred embodiment of the present invention, an antenna controller 10 is coupled to an actuator 12 for an antenna 14 and to a mechanical polarizer 16 for the antenna 14. The antenna controller 10 includes a memory 18, a keypad 20 and a processor 22. Antenna alignment data is displayed by a television monitor 24 that is coupled to the antenna 14 by a satellite receiver 26. The rotational position of the antenna is displayed as a position count. The antenna controller 10 and satellite receiver 26 are housed in a common chassis 28, except that the controller keypad 20 is contained in a remote control unit. This embodiment of the invention further includes a data loading unit 30, which may be coupled to the controller memory 18 for down loading and/or up loading antenna alignment data and antenna skew data.

Figure 2:
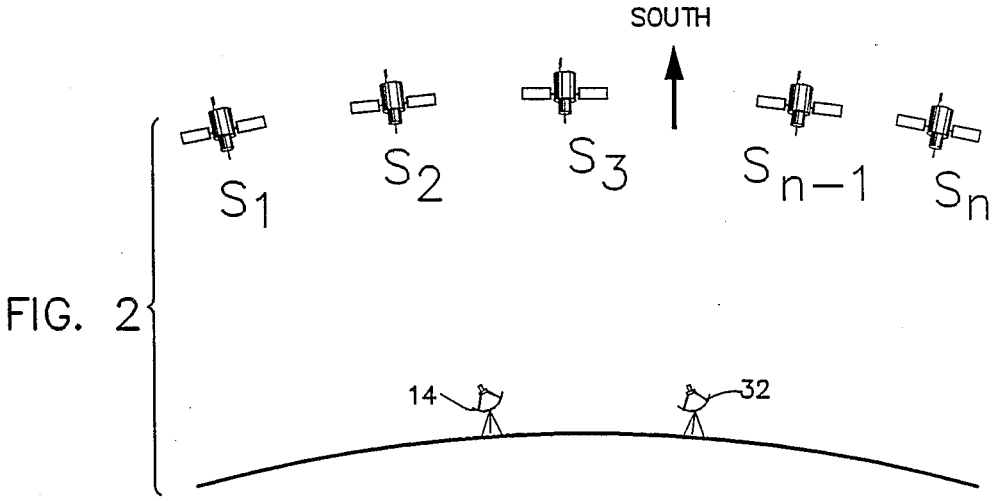
FIG. 2 is a diagram illustrating a satellite antenna on Earth and a plurality of satellites in stationary orbit.

The operation of this embodiment is aligning the antenna 14 with a plurality of satellites $S_1$, $S_2$, $S_3$, $S_{n-1}$ and $S_n$, as shown in FIG. 2, is as follows. The alignment positions and the skew data of a reference antenna 32 for the plurality of satellites $S_1$, $S_2$, $S_3$, $S_{n-1}$ and $S_n$. is uploaded into the controller memory 18 by the data loading unit 30. The data loading unit 30 can be connected to the controller 10 via a single multi-pin connector such as DIN. The power to the data loading unit 30 is supplied by the controller 10.

Before the alignment positions of a newly installed antenna 14 are determined, it is first necessary to determine and store in the controller memory 18, the east and west limits of antenna 14 movement. The east and west limits are electronic limits to prevent rotation of the antenna 14 beyond certain points.

Next the alignment positions of the antenna 14 is measured for two reference satellites $S_1$ and $S_n$. In order to measure the alignment positions of the antenna 14 for the reference satellite $S_1$, the controller 10 is operated to move the actuator 12 to rotate the antenna 14 into alignment with the first reference satellite $S_1$. When alignment is achieved, as determined by observing the quality of the television signal being received from the satellite $S_1$ and displayed by the monitor 24, the alignment position indicated by the position count that is displayed by the monitor 24 is stored in a memory location within the controller memory 18 that is associated with the given satellite $S_1$. The same procedure is repeated with respect to the second reference satellite $S_n$.

The controller processor 22 is adapted to process the stored measurements of the alignment positions of the antenna 14 for the two reference satellites with the stored data indicating the alignment positions of the reference antenna 32 for the plurality of satellites $S_1$, $S_2$, $S_3$, $S_{n-1}$ and $S_n$ in accordance with a first algorithm in order to determine the alignment position of the antenna 14 for each of the satellites $S_1$, $S_2$, $S_3$, $S_{n-1}$ and $S_n$, except the two reference satellites $S_1$ and $S_n$. The first algorithm enables the alignment position P'' of the antenna to be determined for a given satellite $S_i$. The first algorithm is expressed by Equation 1, as follows:

$$P_i'' = P_j' + \{[(P_i - P_j)(P_k' - P_j')] \div (P_k - P_j)\}; \quad (1)$$

wherein $P_i$ is the stored alignment position of the reference antenna for the given satellite, $P_j$ is the stored alignment position of the reference antenna for the first reference satellite, $P_k$ is the stored alignment position of the reference antenna for the second reference satellite, $P_j'$ is the measured alignment position of the first said antenna for the first reference satellite, and $P_k'$ is the measured alignment position of the first said antenna for the second reference satellite.

Note that $P_i''$ becomes $P_k'$, when i=k and $P_i''$ becomes $P_j'$, when i=j, as expected. In the event that the alignment position for any satellite determined by the processor 22 is beyond the east limit or the west limit, such alignment position will not be stored in the memory 18.

The alignment positions for each of the satellites $S_1$, $S_2$, $S_3$, $S_{n-1}$ and $S_n$ that are determined by the processor 22 are stored in locations in the memory 18 associated with the respective satellites $S_1$, $S_2$, $S_3$, $S_{n-1}$ and $S_n$ so that the antenna 14 can be rotated to a position in alignment with any given satellite simply by accessing the stored alignment position associated with the given satellite and causing the controller 10 to move the actuator 12 to rotate the antenna 14 until the antenna position corresponds to the accessed alignment position.

The controller 10 also is adapted to determine the skews of the linear polarization axis of the antenna 14 for respectively matching the linear polarization axis of odd-numbered and even-numbered channels recieved from any given one of the satellites $S_1$, $S_2$, $S_3$, $S_{n-1}$ and $S_n$. To make such determinations, the controller 10 is operated to rotate the probe within a mechanical polarizer 16 of the antenna 12 until the linear polarization axis of the antenna 14 is matched with the linear polarization axis of the received channel, the measured skew data for such channel is stored in a location within the memory 18 that is associated with such channel for the given satellite so that the antenna. This procedure is followed for both an even channel and an odd channel of the given satellite.

The controller processor 22 is adapted for processing the measured skew data for the even and odd channels with the stored data indicating the relative skews for matching the linear polarization of odd-numbered even-numbered channels received by the reference antenna from the given satellite in accordance with second and third algorithms to determine the skew of the linear polarization axis of the antenna for respectively matching the linear polarization axis of both odd and even-numbered channels received from the given satellite.

The controller processor 22 is adapted for determining the the skew E'' of the linear polarization axis of the antenna 14 for matching the linear polarization axis of even-numbered channels received from the given satellite in accordance with the following second algorithm:

$$E_i'' = O_j' + \{[(E_i - O_j)(E_j' - O_j')] \div (E_j - O_j)\}; \quad (2)$$

wherein $E_i$ is the stored skew for matching the linear polarization axis of even-numbered channels received by the reference antenna from the given satellite, $O_i$ is the stored skew for matching the linear polarization axis of odd-numbered channels received by the reference antenna from the given satellite, $E_j'$ is the measured skew of the linear polarization axis of the antenna for matching the linear polarization axis of even-numbered channels received from the given satellite, and $O_j'$ is the measured skew of the linear polarization axis of the antenna for matching the linear polarization axis of odd-numbered channels received from the given satellite.

The controller processor 22 is adapted for determining the the skew E'' of the linear polarization axis of the antenna 14 for matching the linear polarization axis of odd-numbered channels received from the given satellite in accordance with the following third algorithm:

$$O_i''=O_j'+\{[(O_i-O_j)(E_j'-O_j')]\div(E_j-O_j)\}; \quad (3)$$

wherein $E_i$ is the stored skew for matching the linear polarization axis of even-numbered channels received by the reference antenna from the given satellite, $O_i$ is the stored skew for matching the linear polarization axis of odd-numbered channels received by the reference antenna from the given satellite, $E_j'$ is the measured skew of the linear polarization axis of the antenna for matching the linear polarization axis of even-numbered channels received from the given satellite, and $O_j'$ is the measured skew of the linear polarization axis of the antenna for matching the linear polarization axis of odd-numbered channels received from the given satellite.

Note that $E_i''$ and $O_i''$ become $E_j'$ and $O_j'$ when i=j. In the event that either $E_i''$ or $O_i''$ exceeds a limit of ±90 degrees, then the calculated value of E'' or O'' will be limited to ±90 degrees.

The skews for each of the satellites $S_1$, $S_2$, $S_3$, $S_{n-1}$ and $S_n$ that are determined by the processor 22 in accordance with the second and third algorithms are stored in locations in the memory 18 associated with the respective satellites $S_1$, $S_2$, $S_3$, $S_{n-1}$ and $S_n$ so that the antenna probe can be skewed to match the linear polarization axis for such channel of the given satellite whenever the antenna 14 is rotated to a position in alignment with the given satellite simply by accessing the stored skew data associated with such channel of the given satellite and causing the controller 10 to rotate the probe until the probe position corresponds to the accessed skew data.

In an alternative preferred embodiment, the data loading unit 30 is not included; and alignment position data and skew data for the controller 10 are determined without using alignment position data and skew data for a reference antenna. In this embodiment there is stored in the memory 18, data indicating the longitudinal positions each of the satellites $S_1$, $S_2$, $S_3$, $S_{n-1}$ and $S_n$ and data indicating the respective linear polarization axis for odd-numbered and even-numbered channels for each of a the satellites $S_1$, $S_2$, $S_3$, $S_{n-1}$ and $S_n$. This data is all published and readily available.

As with the first preferred embodiment using the data loading unit 30, the alignment position of the antenna 14 for two reference satellites must be determined before the controller processor 22 can determine the alignment positions for any given one of the satellites $S_1$, $S_2$, $S_3$, $S_{n-1}$ and $S_n$. The alignment positions of the antenna 14 for two reference satellites $S_1$ and $S_n$ are measured in the same manner as described for the first embodiment and the alignment positions determined by such measurements are stored in locations of the memory 18 associated with the two reference satellites $S_1$ and $S_n$.

In this second embodiment, the controller processor 22 is adapted for determining satellite alignment positions for antennas that are aligned by using a transmission-type actuator, an East-side linear actuator and a West-side linear actuator.

With a transmission-type actuator, the pulse count indication of alignment position is directly proportional to the steering angle of the antenna 14 around the polar axis. Since the steering angle of the antenna 14 can be estimated from the longitudinal position of the satellite by using the linear interpolation, the alignment position of the antenna is determined in accordance with a linear interpolation algorithm. Thus, when the antenna 14 is aligned with a transmission-type actuator 12, the controller processor 22 determines the alignment positions $P_i$ of the antenna 14 for any given satellite in accordance with a fourth algorithm, as follows:

$$P_i=K\times(L_i-L_E)+P_E; \quad (4)$$

wherein $K=(P_W-P_E)\div(L_W-L_E)$;

$L_i$ is the longitudinal position of the given satellite;

$L_E$ is the longitudinal position of a reference satellite that is located East of the given satellite;

$L_W$ is the longitudinal position of a reference satellite that is located West of the given satellite;

$P_E$ is the measured alignment position of the antenna for the reference satellite that is located East of the given satellite; and $P_W$ is the measured alignment position of the antenna for the reference satellite that is located West of the given satellite.

Figure 3:
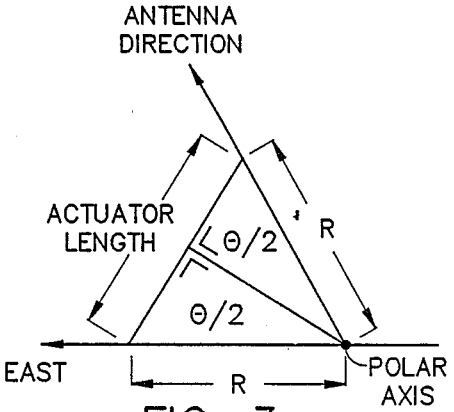
FIG. 3 illustrates the alignment of an antenna when using an East-side linear actuator.
Figure 4:
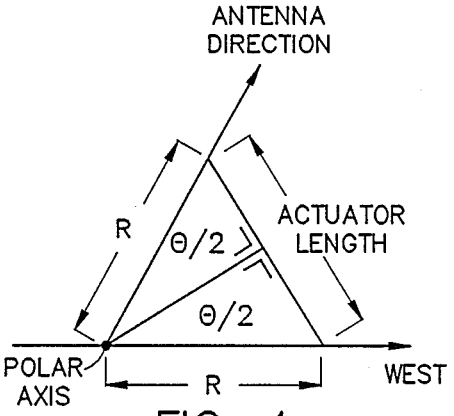
FIG. 4 illustrates the alignment of an antenna when using an West-side linear actuator.

With either an East-side or West-side linear actuator, the pulse count indication of alignment position is porportional to the Sine function of half the steering angle $\theta$ as shown in FIGS. 3 and 4.

Thus, when the antenna 14 is aligned with an East-side linear actuator 12, the controller processor 22 determines the alignment positions $P_i$ of the antenna 14 for any given satellite in accordance with a fifth algorithm, as follows:

$$P_i=K\times[\{\sin[(L_i-L_E+\theta)\div 2]\}-\sin(\theta\div 2)]+P_E; \quad (5)$$

wherein $K=(P_W-P_E)\div\{\sin[(L_W-L_E+\theta)\div 2]-\sin(\theta\div 2)\}$;

$L_i$ is the longitudinal position of the given satellite;

$L_E$ is the longitudinal position of a reference satellite that is located East of the given satellite;

$L_W$ is the longitudinal position of a reference satellite that is located West of the given satellite;

$P_E$ is the measured alignment position of the antenna for the reference satellite that is located East of the given satellite;

$P_W$ is the measured alignment position of the antenna for the reference satellite that is located West of the given satellite; and $\theta$ is the steering angle of the antenna when it is aimed at the reference satellite that is located East of the given satellite.

When the antenna 14 is aligned with an West-side linear actuator 12, the controller processor 22 determines the alignment positions $P_i$ of the antenna 14 for any given satellite in accordance with a sixth algorithm, as follows:

$$P_i = -K \times [\{\sin [(L_w - L_i + \theta) \div 2]\} - \sin (\theta \div 2)] + P_W; \quad (6)$$

wherein $K = (P_W - P_E) \div \{\sin [(L_W - L_E + \theta) \div 2] - \sin (\theta \div 2)\}$;

$L_i$ is the longitudinal position of the given satellite;

$L_E$ is the longitudinal position of a reference satellite that is located East of the given satellite;

$L_W$ is the longitudinal position of a reference satellite that is located West of the given satellite;

$P_E$ is the measured alignment position of the antenna for the reference satellite that is located East of the given satellite;

$P_W$ is the measured alignment position of the antenna for the reference satellite that is located West of the given satellite; and $\theta$ is the steering angle of the antenna when it is aimed at the reference satellite that is located West of the given satellite.

For simplicity, but without loss of generalities, it is assumed that the position count $P_W > P_E$ and that the longitude $L_W > L_E$.

The skews of the antenna for the satellite $S_1$, $S_2$, $S_3$, $S_{n-1}$ and $S_n$ can be easily programmed by measuring the skews of the linear polarization axis of the antenna 14 for matching the linear polarization axis of odd-numbered and even-numbered channels received from a reference satellite; and then storing in the memory 18, the skews of the linear polarization axis of the antenna 14 for matching the linear polarization axis of odd-numbered and even-numbered channels received from the plurality of different satellites in accordance the measured skews with the initially stored publicly known polarization axis data.

We claim:

1. A system for causing an antenna controller for a satellite antenna to automatically determine the alignment position of the antenna for geosysnchronous satellites, comprising means for measuring the alignment position of the antenna for at least two reference satellites; and means for processing said measurements with stored data indicating the relative positions of the reference satellites and other satellites in accordance with an algorithm to determine the alignment positions of the antenna for the other satellites.

2. A system according to claim 1, wherein the stored data indicates the alignment positions of a reference antenna for the reference satellites and the other satellites.

3. A system according to claim 2, wherein the processing means determine the alignment position $P_i''$ of the antenna for a satellite (i) in accordance with the following algorithm:

$$P_i'' = P_j' + \{[(P_i - P_j)(P_k' - P_j')] \div (P_k - P_j)\};$$

wherein $P_i$ is the stored alignment position of the reference antenna for the satellite (i), $P_j$ is the stored alignment position of the reference antenna for the first reference satellite (j), $P_k$ is the stored alignment position of the reference antenna for the second reference satellite (k), $P_j'$ is the measured alignment position of the first said antenna for the first reference satellite (j), and $P_k'$ is the measured alignment position of the first said antenna for the second reference satellite (k).

4. A system according to claim 1, wherein the stored data indicates the longitudinal positions of the reference satellites and the other satellites.

5. A system according to claim 4, wherein the processing means determine the alignment position $P_i$ of the antenna for a satellite (i), when the antenna is aligned with a transmission-type actuator, in accordance with the following algorithm:

$$P_i = K \times (L_i - L_E) + P_E;$$

wherein $K = (P_W - P_E) \div (L_W - L_E)$;

$L_i$ is the longitudinal position of the satellite (i);

$L_E$ is the longitudinal position of a reference satellite that is located East of the satellite (i);

$L_W$ is the longitudinal position of a reference satellite that is located West of the satellite (i);

$P_E$ is the measured alignment position of the antenna for the reference satellite that is located East of the satellite (i); and $P_W$ is the measured alignment position of the antenna for the reference satellite that is located West of the satellite (i).

6. A system according to claim 4, wherein the processing means determine the alignment position $P_i$ of the antenna for a satellite (i), when the antenna is aligned with an East-side linear actuator, in accordance with the following algorithm:

$$P_i = K \times [\{\sin [(L_i - L_E + \theta) \div 2]\} - \sin (\theta \div 2)] + P_E;$$

wherein $K = (P_W - P_E) \div \{\sin [(L_W - L_E + \theta) \div 2] - \sin (\theta \div 2)\}$;

$L_i$ is the longitudinal position of the satellite (i);

$L_E$ is the longitudinal position of a reference satellite that is located East of the satellite (i);

$L_W$ is the longitudinal position of a reference satellite that is located West of the satellite (i);

$P_E$ is the measured alignment position of the antenna for the reference satellite that is located East of the satellite (i);

$P_W$ is the measured alignment position of the antenna for the reference satellite that is located West of the satellite (i); and $\theta$ is the steering angle of the antenna when it is aimed at the reference satellite that is located East of the satellite (i).

7. A system according to claim 4, wherein the processing means determine the alignment position $P_i$ of the antenna for a satellite (i), when the antenna is aligned with an West-side linear actuator, in accordance with the following algorithm:

$$P_i = -K \times [\{\sin [(L_w - L_i + \theta) \div 2]\} - \sin (\theta \div 2) + P_W;$$

wherein $K = (P_W - P_E) \div \{\sin [(L_W - L_E + \theta) \div 2] - \sin (\theta \div 2)\}$;

$L_i$ is the longitudinal position of the satellite (i);

$L_E$ is the longitudinal position of a reference satellite that is located East of the satellite (i);

$L_W$ is the longitudinal position of a reference satellite that is located West of the satellite (i);

$P_E$ is the measured alignment position of the antenna for the reference satellite that is located East of the satellite (i);

$P_W$ is the measured alignment position of the antenna for the reference satellite that is located West of the satellite (i); and $\theta$ is the steering angle of the antenna when it is aimed at the reference satellite that is located West of the satellite (i).

8. A system according to claim 1, further comprising means for causing an antenna controller for a given satellite antenna to determine the skews of the linear polarization axis of the given antenna for respectively matching the linear polarization axis of odd-numbered and even-numbered channels received from a given satellite, comprising means for measuring the relative skews of the linear polarization axis of the given antenna for matching the linear polarization axis of odd-numbered and even-numbered channels received by the given antenna from the given satellite; and means for processing said measurements with stored data indicating relative skews for matching the linear polarization axis of odd-numbered even-numbered channels received by a reference antenna from the given satellite in accordance with an algorithm to determine the skew of the linear polarization axis of the antenna for respectively matching the linear polarization axis of odd and even-numbered channels received from the given satellite.

9. A system according to claim 8, wherein the processing means determine the the skew E″ of the linear polarization axis of the given antenna for matching the linear polarization axis of even-numbered channels received from a satellite (i) in accordance with the following algorithm:

$$E_i'' = O_j' + \{[(E_i - O_j)(E_j' - O_j')] \div (E_j - O_j)\};$$

wherein $E_i$ is the stored skew for matching the linear polarization axis of even-numbered channels received by the reference antenna from the satellite (i), $O_i$ is the stored skew for matching the linear polarization axis of odd-numbered channels received by the reference antenna from the satellite (i), $E_j'$ is the measured skew of the linear polarization axis of the given antenna for matching the linear polarization axis of even-numbered channels received from the satellite (i), and $O_j'$ is the measured skew of the linear polarization axis of the given antenna for matching the linear polarization axis of odd-numbered channels received from the given satellite (i).

10. A system according to claim 8, wherein the processing means determine the the skew O″ of the linear polarization axis of the antenna for matching the linear polarization axis of odd-numbered channels received from the satellite (i) in accordance with the following algorithm:

$$O_i'' = O_j' + \{[(O_i - O_j)(E_j' - O_j')] \div (E_j - O_j)\};$$

wherein $E_i$ is the stored skew for matching the linear polarization axis of even-numbered channels received by the reference antenna from the satellite (i), $O_i$ is the stored skew for matching the linear polarization axis of odd-numbered channels received by the reference antenna from the satellite (i), $E_j'$ is the measured skew of the linear polarization axis of the given antenna for matching the linear polarization axis of even-numbered channels received from the satellite (i), and $O_j'$ is the measured skew of the linear polarization axis of the given antenna for matching the linear polarization axis of odd-numbered channels received from the satellite (i).

11. A system according to claim 8, further comprising a portable device into which data indicating the relative skews for matching the linear polarization axis of odd-numbered and even-numbered channels received by a reference antenna from a given satellite may be downloaded from the antenna controller for the reference antenna, and from which the downloaded data may be uploaded into the first said antenna controller for said storage therein.

12. A system according to claim 8, further comprising a portable device into which data indicating the relative positions of the reference satellites and other satellites and data indicating relative skews for matching the linear polarization axis of odd-numbered and even-numbered channels received by a reference antenna from the satellites may be downloaded from the antenna controller for the reference antenna, and from which the downloaded data may be uploaded into the first said antenna controller for said storage therein.

13. A system according to claim 1, further comprising a portable device into which data indicating the relative positions of the reference satellites and the other satellites may be downloaded from an antenna controller for a reference antenna and from which the downloaded data may be uploaded into the first said antenna controller for said storage therein.

14. A system according to claim 1, further comprising means in the antenna controller storing data indicating the respective linear polarization axis for odd-numbered and even-numbered channels for each of a plurality of different satellites;

means for measuring the skews of the linear polarization axis of the antenna for matching the linear polarization axis of odd-numbered and even-numbered channels received from a reference satellite; and means for programming the antenna controller with the skews of the linear polarization axis of the antenna for matching the linear polarization axis of odd-numbered and even-numbered channels received from the plurality of different satellites in accordance with the stored polarization axis data and the measured skews.

* * * * *